US006497482B1

(12) United States Patent
Matsuyama

(10) Patent No.: US 6,497,482 B1
(45) Date of Patent: Dec. 24, 2002

(54) TARGET LENS SHAPE MEASURING DEVICE AND EYEGLASS-LENS PROCESSING APPARATUS HAVING THE SAME

(75) Inventor: Yoshinori Matsuyama, Aichi (JP)

(73) Assignee: Nidek Co., Ltd., Aichi (JP)

( * ) Notice: Subject to any disclaimer, the term of this patent is extended or adjusted under 35 U.S.C. 154(b) by 39 days.

(21) Appl. No.: 09/583,874

(22) Filed: May 31, 2000

(30) Foreign Application Priority Data

May 31, 1999 (JP) ..... 11-151231

(51) Int. Cl.[7] ..... G02C 13/00
(52) U.S. Cl. ..... 351/41; 451/42; 356/124
(58) Field of Search ..... 351/41, 42, 154, 351/178; 451/5, 11, 42, 43, 239, 240, 237, 256; 356/124, 125, 126, 127

(56) References Cited

U.S. PATENT DOCUMENTS

| | | | | |
|---|---|---|---|---|
| 4,945,684 A | * | 8/1990 | Wada et al. | 451/5 |
| 5,121,550 A | | 6/1992 | Wood et al. | 33/551 |
| 5,138,770 A | | 8/1992 | Matsuyama | 33/28 |
| 5,228,242 A | | 7/1993 | Matsuyama | 51/165.74 |
| 5,333,412 A | | 8/1994 | Matsuyama | 51/165.71 |
| 5,521,700 A | * | 5/1996 | Kajino et al. | 356/124 |
| 5,605,498 A | * | 2/1997 | Nauche | 451/240 |
| RE35,898 E | | 9/1998 | Shibata et al. | 451/5 |
| 5,959,199 A | | 9/1999 | Suzuki et al. | 73/104 |
| 6,006,592 A | | 12/1999 | Suzuki et al. | 73/104 |

FOREIGN PATENT DOCUMENTS

| | | | |
|---|---|---|---|
| JP | 63-174858 | 7/1988 | B24B/9/14 |
| JP | 3-20603 | 1/1991 | G01B/5/06 |
| JP | 6-194153 | 7/1994 | G01B/21/20 |
| JP | 10-217086 | 8/1998 | B24B/9/14 |

* cited by examiner

*Primary Examiner*—George Manuel
(74) *Attorney, Agent, or Firm*—Sughrue Mion, PLLC

(57) ABSTRACT

A target lens shape measuring device for measuring a target lens shape for processing an eyeglass lens includes: amount on which at least one of a template and a base of a fixing cup to which a dummy lens is attached is to be mounted; a fixing portion for pressing and fixing the template or the dummy lens mounted on the mount during measurement; a moving mechanism for moving the fixing portion between a pressing position, at which the fixing portion presses the template or the dummy lens, and a non-pressing position; a measuring pin to be brought into contact with a periphery of the template or the dummy lens mounted on the mount; a movement detecting mechanism for detecting an amount of movement of the measuring pin to obtain a target lens shape; and a linking mechanism for moving the measuring pin from a retracted position to a measuring position in linking with movement of the fixing portion to the pressing position by the moving mechanism.

11 Claims, 8 Drawing Sheets

TARGET LENS SHAPE MEASURING DEVICE AND EYEGLASS-LENS PROCESSING APPARATUS HAVING THE SAME

BACKGROUND OF THE INVENTION

The present invention relates to a target lens shape measuring device for measuring a target lens shape of a template or a dummy lens obtained by tracing the shape of a lens frame of an eyeglass frame, and an eyeglass-lens processing apparatus having the same.

An eyeglass-lens processing apparatus using a target lens shape of a template has been designed to process an eyeglass lens while tracing the template attached to a lens rotating shaft of the processing apparatus. However, recent, popular eyeglass-lens processing apparatuses are designed to measure the target lens shape of the template in the same way as the eyeglass frame, and then process a lens on the basis of data on the target lens shape.

A target lens shape measuring device for measuring the target lens shape of the template includes a measuring pin which is brought into contact with an end face of a fixed template; a moving mechanism for moving the measuring pin; and a detecting mechanism for detecting the amount of movement of the measuring pin. Although some target lens shape measuring devices are configured as dedicated devices, most of the devices are designed to commonly use mechanisms provided in an eyeglass frame shape measuring device, such as a moving mechanism for moving a feeler (that is to be inserted into a frame groove) and a detecting mechanism for detecting the amount of movement of the feeler.

Besides, the eyeglass frame shape measuring device requires a relatively large space since it has a mechanism for rotating the feeler for obtaining information on the radius vector of the frame, and other components such as a slider for holding the frame in a measurable state (i.e., a slider for moving a pair of abutment members respectively coming into contact with upper and lower portions of the lens frame to clamp and hold the frame by the movement of the abutment members).

In the case of the frame shape measuring device that is also designed as the measuring mechanism for the template, it is necessary to separately prepare a fixing jig for fixing the template. For the measurement of the template, it is required to fix the template to the fixing jig by screws or the like, and attach the fixing jig to a template measuring position in the frame shape measuring device. Hence, time and trouble are involved in the measurement, and the operational efficiency is not satisfactory.

On the other hand, in the case of the device dedicated for the measurement of the template, it is unnecessary to prepare the fixing jig. However, after fixing the template, the measuring pin must be moved so as to be set in a measuring state in which the measuring pin is brought into contact with the end face of the template, and if this movement is effected by a motor, the cost becomes high correspondingly, hindering the provision of the inexpensive device. If this movement is effected manually, the operation is troublesome.

In addition, there has been no target lens shape measuring device provided with a measuring mechanism for the template measurement and a measuring mechanism for the frame measurement independently. In providing the device with both measuring mechanisms, it is desirable to make the device as compact as possible.

SUMMARY OF THE INVENTION

In view of the drawbacks mentioned above, it is an object of the invention to provide a target lens shape measuring device which is superior in operational efficiency and is capable of saving the space for installing the mechanisms while improving the operational efficiency, and an eyeglass-lens processing apparatus having the same.

The present invention provides the followings:

(1) A target lens shape measuring device for measuring a target lens shape for processing an eyeglass lens, said device comprising:

a mount on which at least one of a template and a base of a fixing cup to which a dummy lens is attached is to be mounted;

a fixing portion for pressing and fixing the template or the dummy lens mounted on the mount during measurement;

moving means for moving the fixing portion between a pressing position, at which the fixing portion presses the template or the dummy lens, and a non-pressing position;

a measuring pin to be brought into contact with a periphery of the template or the dummy lens mounted on the mount;

movement detecting means for detecting an amount of movement of the measuring pin to obtain a target lens shape; and linking means for moving the measuring pin from a retracted position to a measuring position in linking with movement of the fixing portion to the pressing position by the moving means.

(2) The target lens shape measuring device of (1), wherein the mount includes a side wall portion on which positioning pins for insertion into small holes of the template are projectingly provided, and an insertion hole surrounded by the side wall portion for receiving the base of the fixing cup.

(3) The target lens shape measuring device of (1), further comprising:

rotating means for rotating the mount, wherein the fixing portion includes a rotatable contact portion to be brought into contact with the template or the dummy lens mounted on the mount.

(4) The target lens shape measuring device of (1), further comprising:

rotating means for rotating the mount;

rotation detecting means for detecting a rotational angle of the rotating means or a rotational angle of the mount by the rotating means;

arithmetic means for obtaining the target lens shape based on the amount of movement of the measuring pin detected by the movement detecting means and the rotational angle detected by the rotation detecting means.

(5) The target lens shape measuring device of (1), further comprising:

arithmetic means for obtaining the target lens shape based on the amount of movement of the measuring pin detected by the movement detecting means.

(6) The target lens shape measuring device of (1), further comprising:

an eyeglass frame holding unit including:

a pair of sliders to be respectively brought into contact with upper and lower end surfaces of an eyeglass frame;

clamping pins for clamping the eyeglass frame; and urging means for moving the sliders to a position at which the sliders do not interfere with the template or the dummy lens mounted on the mount, wherein measurement of the template or the dummy lens is carried out using a space obtained as a consequence of moving the sliders by the urging means.

(7) The target lens shape measuring device of (6), further comprising:

position detecting means for detecting whether or not the sliders are located at the position at which the sliders do not interfere with the template or the dummy lens on the mount;

mode determining means for determining a template measurement mode, in which the template or the dummy lens is measured, based on result of detection of the position detecting means.

(8) An eyeglass-lens processing apparatus, having the target lens shape measuring device of (1), for processing the eyeglass lens based on the obtained target lens shape, comprising:

lens processing means having a rotatable abrasive wheel and a lens rotating shaft for holding and rotating the lens; and control means for controlling the lens processing means based on an obtained target lens shape.

The present disclosure relates to the subject matter contained in Japanese patent application No. Hei. 11-151231 (filed on May 31, 1999), which is expressly incorporated herein by reference in its entirety.

DESCRIPTION OF THE PREFERRED EMBODIMENT

Hereafter, a description will be given of an embodiment of the invention.

(1) Overall Construction

Figure 1:
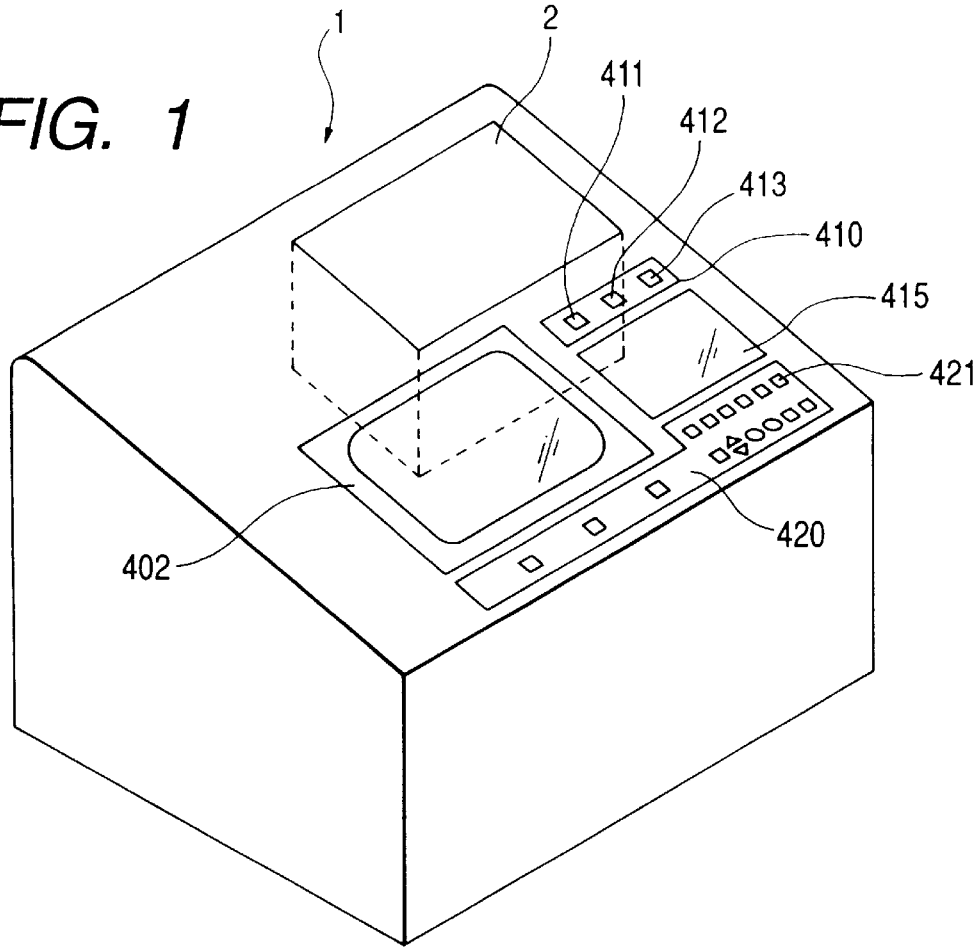
FIG. 1 is a diagram illustrating the external configuration of an eyeglass-lens processing apparatus in accordance with the invention.

FIG. 1 is a diagram illustrating the external configuration of an eyeglass-lens processing apparatus in accordance with the invention. A target lens shape measuring device 2 for measuring a target lens shape of each of an eyeglass frame and a template (including a dummy lens) is incorporated in an upper right-hand rear portion of a main body 1 of the apparatus. A switch panel section 410 having switches for operating the target lens shape measuring device 2 and a display 415 for displaying processing information and the like are disposed in front of the target lens shape measuring device 2. Further, reference numeral 420 denotes a switch panel section having various switches for inputting processing conditions and the like and for giving instructions for processing, and numeral 402 denotes an openable window for a processing chamber.

Figure 2:
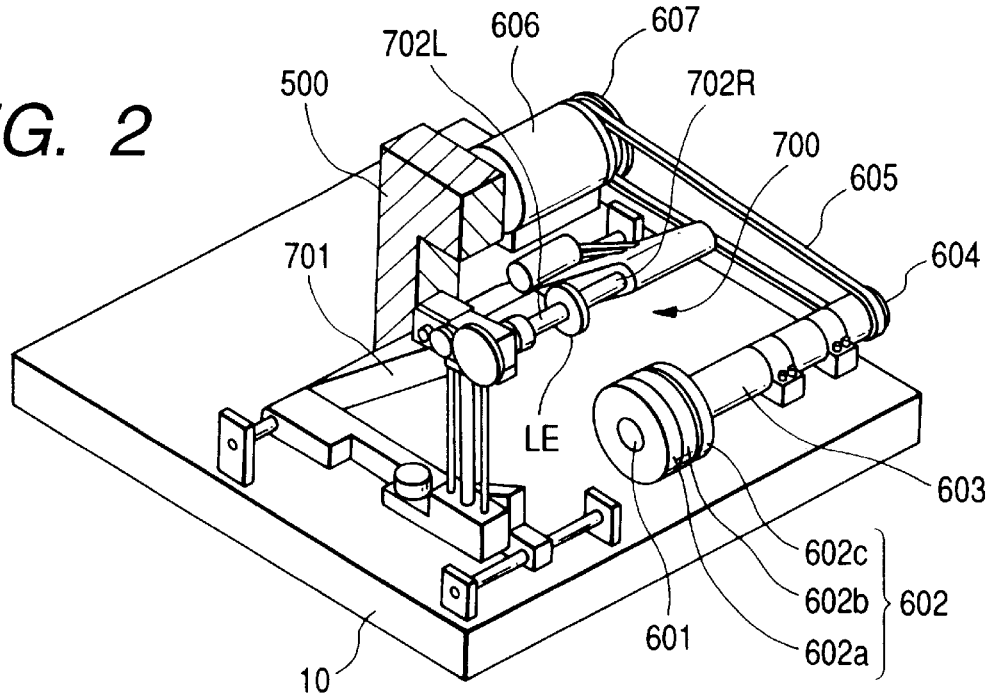
FIG. 2 is a perspective view illustrating the arrangement of a lens processing section disposed in a casing of a main body of the apparatus.

FIG. 2 is a perspective view illustrating the arrangement of a lens processing section disposed in the casing of the main body 1. A carriage unit 700 is mounted on a base 10, and a subject lens LE clamped by a pair of lens chuck shafts of a carriage 701 is ground by a group of abrasive wheels 602 attached to a rotating shaft 601. The group of abrasive wheels 602 include a rough abrasive wheel 602*a* for glass lenses, a rough abrasive wheel 602*b* for plastic lenses, and a finishing abrasive wheel 602*c* for beveling processing and flat processing. The rotating shaft 601 is rotatably attached to the base 10 by a spindle 603. A pulley 604 is attached to an end of the rotating shaft 601, and is linked through a belt 605 to a pulley 607 which is attached to a rotating shaft of an abrasive-wheel rotating motor 606. A lens-shape measuring section 500 is provided in the rear of the carriage 701.

(2) Construction of Various Sections

[Target Lens Shape Measuring Device]

The target lens shape measuring device 2 includes a frame holding section 200, a frame measuring section 240, and a template measuring mechanism section 300.

<Frame Holding Section>

Figure 3:
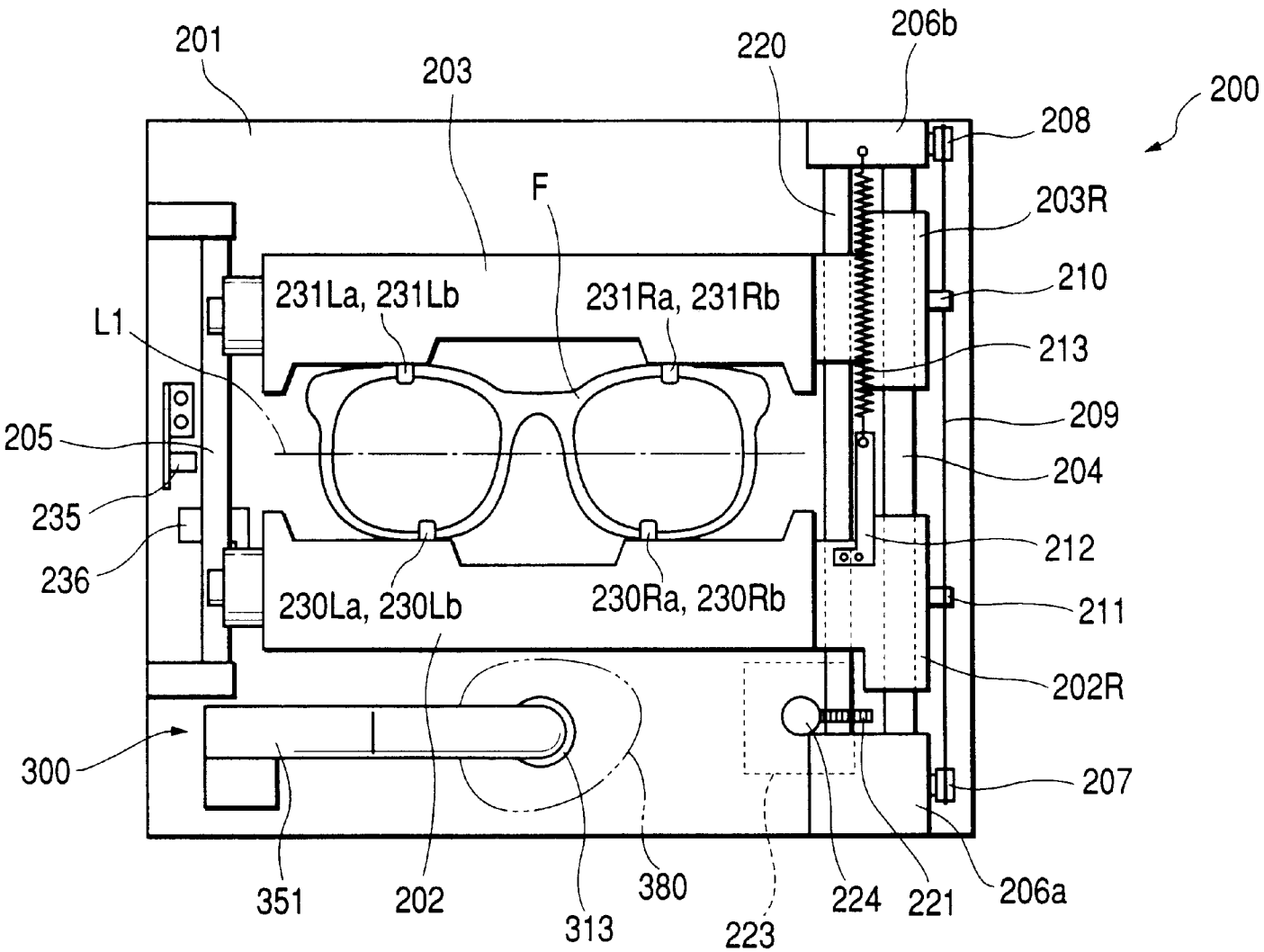
FIG. 3 is a plan view of a frame holding section of a target lens shape measuring device.

Referring to FIG. 3, a description will be given of the construction of the frame holding section 200. FIG. 3 is a plan view of the frame holding section 200.

A front slider 202 and a rear slider 203 for holding an eyeglass frame F are slidably placed on a pair of guide rails 204 and 205 arranged on the right- and left-hand sides of a holding section base 201. As shown in FIG. 3, the rear slider 203 has surfaces contacting upper directional parts of lens frames of the eyeglass frame F, whereas the front slider 202 has surfaces contacting lower directional parts of lens frames of the eyeglass frame F. Pulleys 207 and 208 are rotatably attached respectively to a front-side block 206*a* and a rear-side block 206*b* that support the guide rail 204. An endless wire 209 is suspended on the pulleys 207 and 208. An upper side of the wire 209 is secured to a pin 210 attached to a right end member 203R extending from the rear slider 203, while a lower side of the wire 209 is secured to a pin 211 attached to a right end member 202R extending from the front slider 202. Further, a spring 213 is stretched between the rear-side block 206*b* and the right end member 202R using a mounting plate 212, so that the front slider 202 is constantly urged in the direction in which the spring 213 contracts. Owing to this arrangement, the front slider 202 and the rear slider 203 are slid in a symmetrically opposing manner with respect to a reference line L1 at the center therebtween, and are constantly pulled in directions toward that center (reference line L1) by the spring 213. Accordingly, if one of the front slider 202 and the rear slider 203 is slid in the opening direction, a distance therebetween for holding the frame F can be secured, and if the front slider 202 and the rear slider 203 are in a free state, the distance therebetween is reduced by the urging force of the spring 213.

The frame F is clamped by clamp pins arranged at four locations, i.e. right and left sides of the front slider 202 and right and left sides of the rear slider 203, so as to be held in a reference plane for measurement. Namely, arranged on the front slider 202 are clamp pins 230R*a* and 230R*b* for clamping a right frame rim of the frame F vertically as well as clamp pins 230L*a* and 230L*b* for clamping a left frame rim of the frame F vertically, and these clamp pins are held inside the front slider 202 so as to be opened and closed symmetrically about the measurement reference plane, respectively. Similarly, arranged on the rear slider 203 are clamp pins 231R*a* and 231R*b* for clamping the right frame rim of the frame F vertically as well as clamp pins 231L*a* and 231L*b* for clamping the left frame rim of the frame F vertically, and these clamp pins are held inside the rear slider 203 so as to be opened and closed symmetrically about the measurement reference plane, respectively.

The opening and closing of these clamp pins are effected by driving a clamp motor 223 which is fixed on the reverse side of the holding section base 201. A worm gear 224 attached to a rotating shaft of the motor 223 is in mesh with a wheel gear 221 of a shaft 220 which is rotatably held between the block 206*a* and the block 206*b*, so that the rotation of the motor 223 is transmitted to the shaft 220. The shaft 220 is passed through the right end member 202R and the right end member 203R. Inside the right end member 202R, an unillustrated wire for opening and closing the clamp pins 230R*a*, 230R*b*, 230L*a*, and 230L*b* is attached to the shaft 220, and as the wire is pulled by the rotation of the shaft 220, the opening and closing operation of the clamp pins 230R*a*, 230R*b*, 230L*a*, and 230L*b* are effected simultaneously. Inside the right end member 203R as well, an unillustrated similar wire is also attached to the shaft 220, and the opening and closing operation of the clamp pins 231R*a*, 231R*b*, 231L*a*, and 231L*b* are effected simultaneously by the rotation of the shaft 220. Further, brake pads for securing the opening and closing of the front slider 202 and the rear slider 203 due to the rotation of the shaft 220 are respectively provided inside the right end member 202R and the right end member 203R. As the arrangement of the mechanism for opening and closing the clamp pins, it is possible to use the arrangement disclosed in U.S. Pat. No. 5,228,242 commonly assigned to the present assignee, so that reference is had to made thereto for details.

At the time of measuring the template or the like using the template measuring mechanism section 300, the template measuring mechanism section 300 is used in a state that the front slider 202 and the rear slider 203 are closed. A sensor 235 for detecting that the front slider 202 has been completely closed is attached to an upper surface on the left side of the holding section base 201, while a sensor plate 236 is fixed to a left-side end portion of the front slider 202. A frame measuring section 240 is disposed on the lower side of the holding section base 201.

<Frame Measuring Section>

Figure 4:
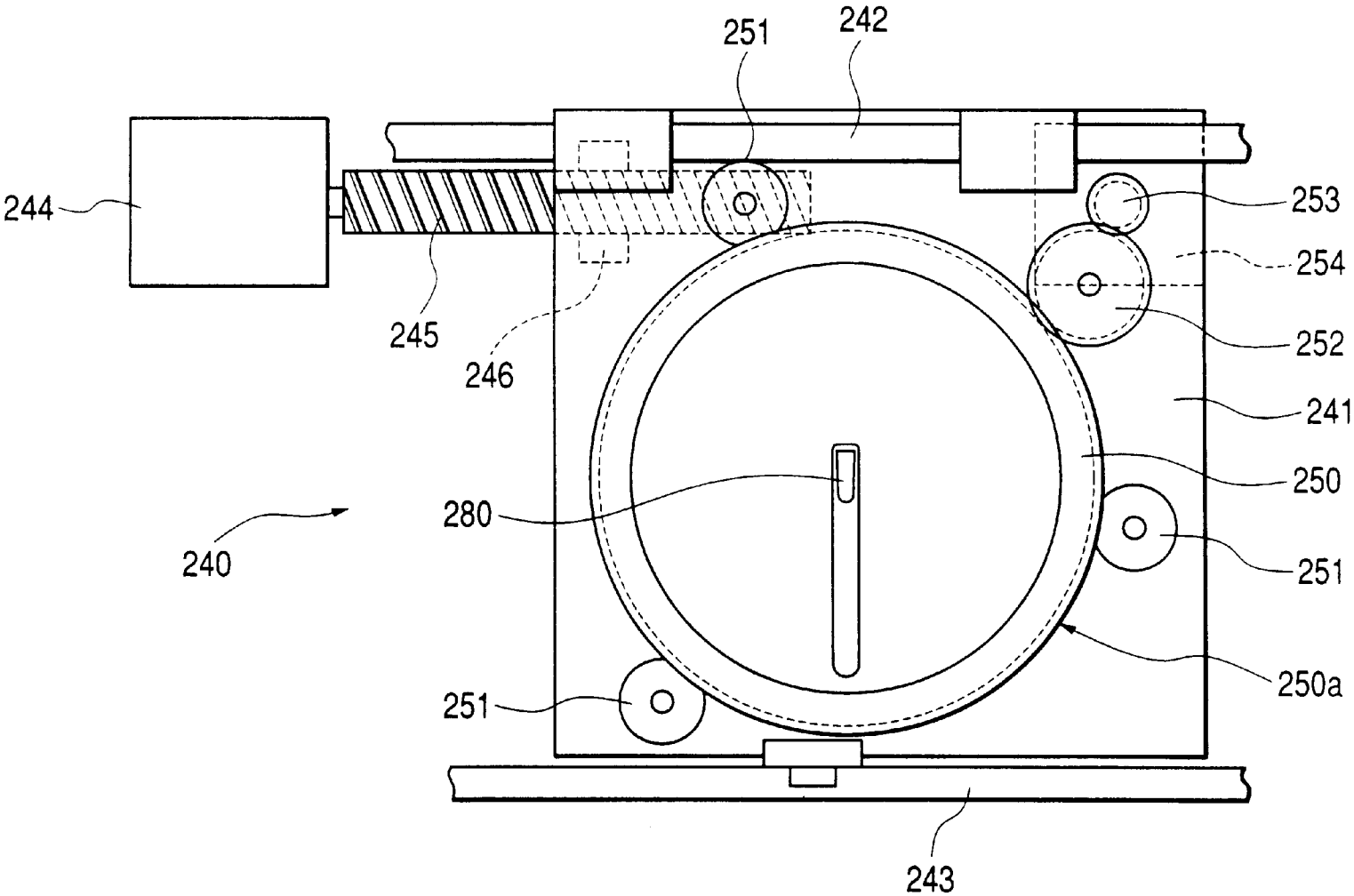
FIG. 4 is a plan view of a measuring section of the target lens shape measuring device.
Figure 5:
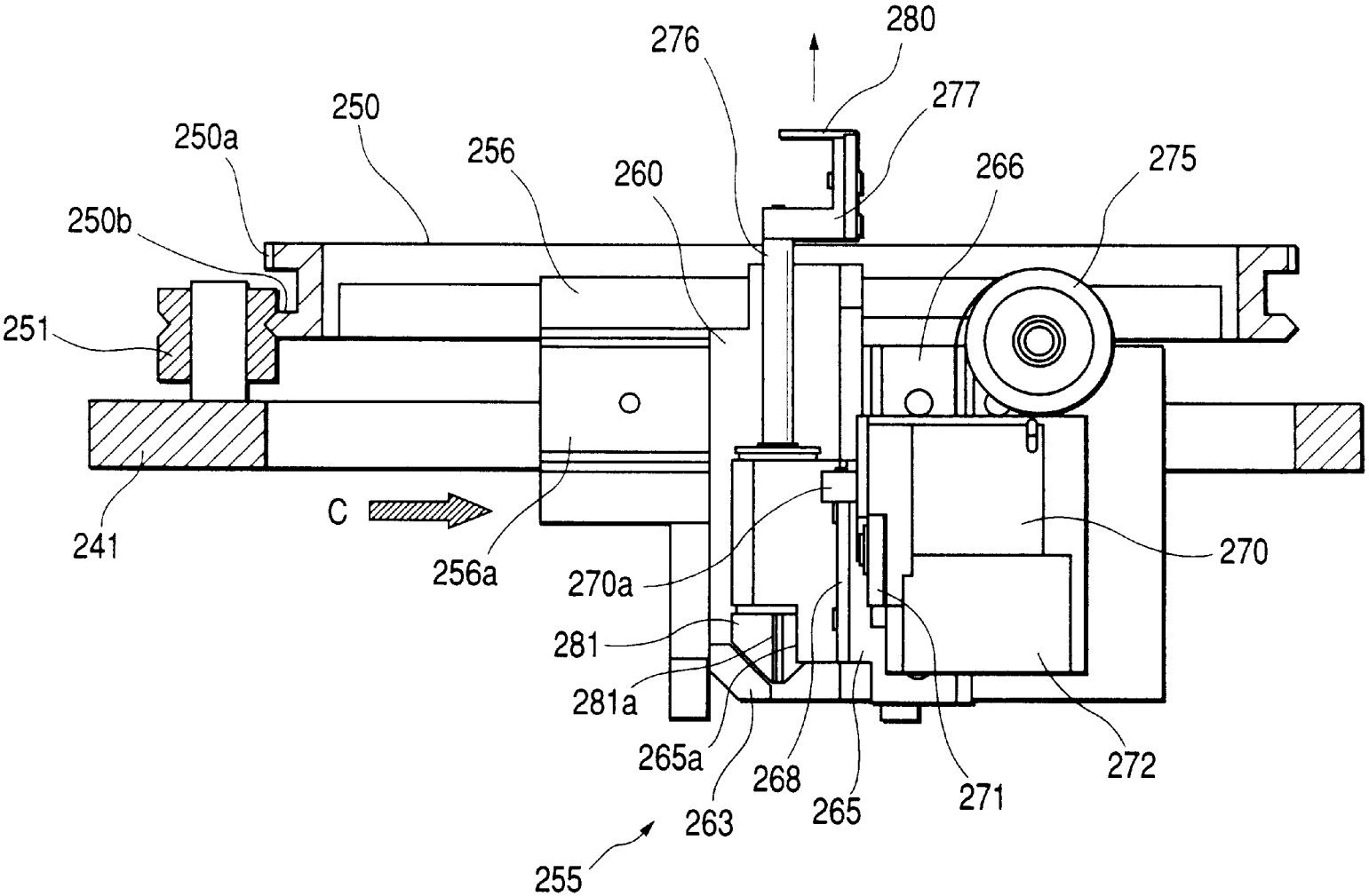
FIG. 5 is a side elevational view for explaining a feeler unit.
Figure 6:
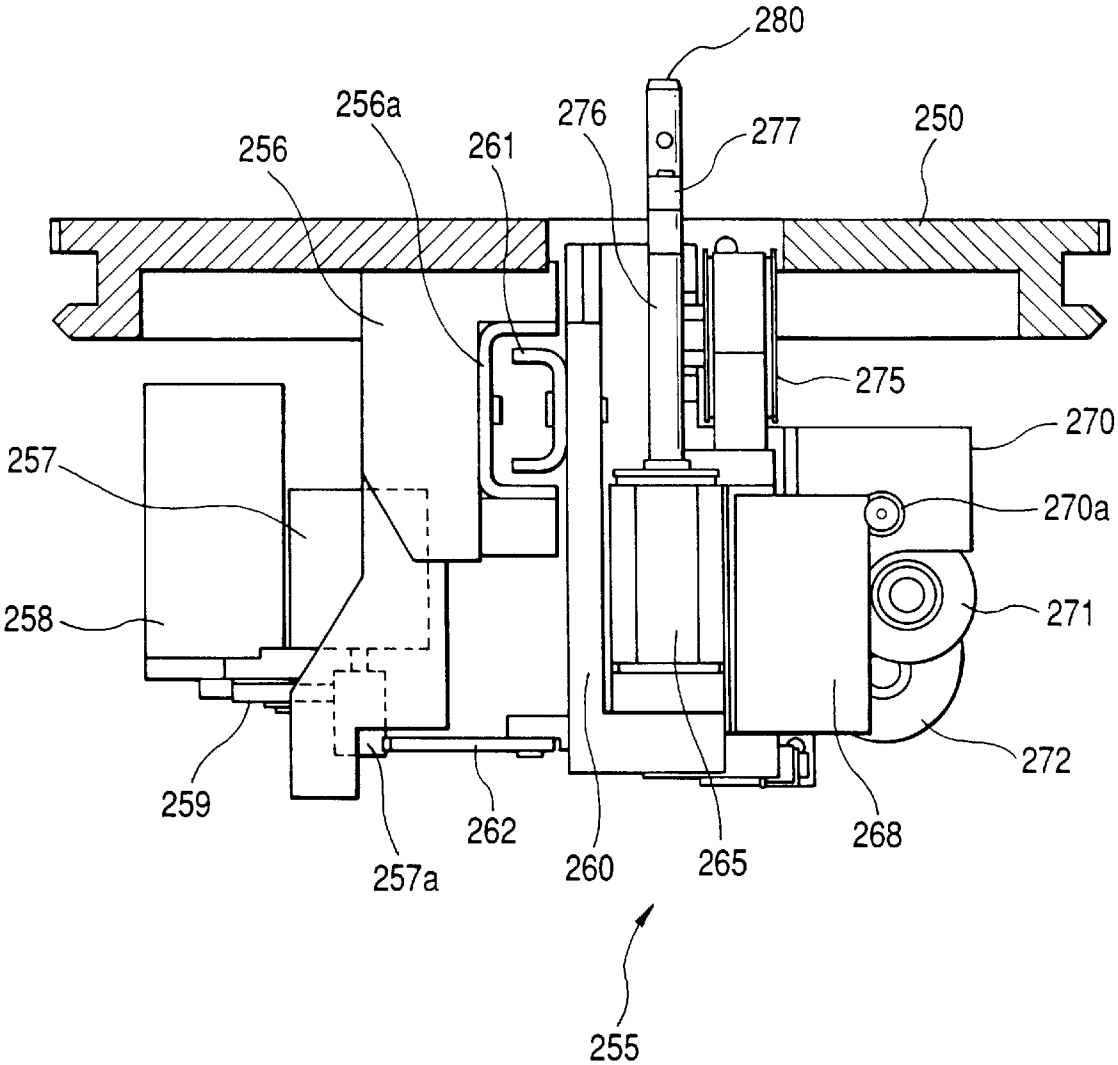
FIG. 6 is a view taken in the direction of arrow C in FIG. 5.

Referring to FIGS. 4 to 6, a description will be given of the construction of the frame measuring section 240. FIG. 4 is a plan view of the measuring section 240. In FIG. 4, a transversely movable base 241 is supported in such a manner as to be transversely slidable along two rails 242 and 243 which are axially supported by the holding section base 201 and extend in the transverse direction. The transverse movement of the transversely movable base 241 is effected by the driving of a motor 244 attached to the holding section base 201. A ball screw 245 is connected to a rotating shaft of the motor 244, and as the ball screw 245 meshes with an internally threaded member 246 fixed on the lower side of the transversely movable base 241, the transversely movable base 241 is moved in the transverse direction by the forward and reverse rotation of the motor 244.

A rotating base 250 is rotatably held on the transversely movable base 241 by rollers 251 provided at three positions. As shown in FIG. 5, a geared portion 250*a* is formed around a circumference of the rotating base 250, and an angular or tapered guide rail 250*b* projecting in a radially outward direction is formed below the geared portion 250*a*. This guide rail 250*b* is brought into contact with a V-shaped groove of each roller 251, and the rotating base 250 rotates while being held by the three rollers 251. The geared portion 250*a* of the rotating base 250 meshes with an idle gear 252, and the idle gear 252 meshes with a gear 253 attached to a rotating shaft of a pulse motor 254 secured to the lower side of the transversely movable base 241. As a result, the rotation of the motor 254 is transmitted to the rotating base 250. A feeler unit 255 is attached to the underside of the rotating base 250.

Referring to FIGS. 5 and 6, a description will be given of the construction of the feeler unit 255. FIG. 5 is a side elevational view for explaining the feeler unit 255, and FIG. 6 is a view taken in the direction of arrow C in FIG. 5.

A fixed block 256 is fixed to the underside of the rotating base 250. A guide rail receiver 256*a* is attached to a side surface of the fixed block 256 in such a manner as to extend in the planar direction of the rotating base 250. A movable base 260 having a slide rail 261 is slidably attached to the guide rail receiver 256*a*. A DC motor 257 for moving the movable base 260 and an encoder 258 for detecting the amount of its movement are attached to a side of the fixed block 256 which is opposite to its side where the guide rail receiver 256*a* is attached. A gear 257*a* attached to a rotating shaft of the motor 257 meshes with a rack 262 fixed to a lower portion of the movable base 260, and the movable base 260 is moved in the left-and-right direction in FIG. 5 by the rotation of the motor 257. Further, the rotation of the gear 257*a* attached to the rotating shaft of the motor 257 is transmitted to the encoder 258 through an idle gear 259, and the amount of movement of the movable base 260 is detected from this amount of rotation.

A vertically supporting base 265 is vertically movably supported by the movable base 260. As for its moving mechanism, in the same way as the movable base 260, a slide rail (not shown) attached to the vertically supporting base 265 is slidably held on a guide rail receiver 266 attached to the movable base 260 and extending in the vertical direction. A vertically extending rack 268 is secured to the vertically supporting base 265, a gear 270*a* of a DC motor 270 attached to the movable base 260 by means of a fixing metal plate meshes with the rack 268, and as the motor 270 rotates, the vertically supporting base 265 is moved vertically. Further, the rotation of the motor 270 is transmitted through an idle gear 271 to an encoder 272 attached to the movable base 260 by means of a fixing metal plate, and the encoder 272 detects the amount of movement of the vertically supporting base 265. Incidentally, a downward load of the vertically supporting base 265 is reduced by a power spring 275 attached to the movable base 260, thereby rendering the vertical movement of the vertically supporting base 265 smooth.

Further, a shaft 276 is rotatably held on the vertically supporting base 265, an L-shaped attaching member 277 is provided at its upper end, and a feeler 280 is fixed to an upper portion of the attaching member 277. The tip of the feeler 280 is aligned with a rotational axis of the shaft 276, and the tip of the feeler 280 is to be brought into contact with a frame groove of the frame F.

A limiting member 281 is attached to a lower end of the shaft 276. This limiting member 281 has a substantially hollow cylindrical shape, and a protrusion 281*a* is formed on its side surface along the vertical direction, while another protrusion 281*a* is formed on the opposite side opposite with respect to the paper surface of FIG. 5. As these two protrusions 281*a* respectively abut against notched surfaces 265*a* (the illustrated notched surface 265*a*, and a similar notched surface 265*a* that is provided on the opposite side with respect to the paper surface of FIG. 5) formed in the vertically supporting base 265, the rotation of the shaft 276 (i.e., the rotation of the feeler 280) is limited to a certain range. An obliquely cut slanting surface is formed on a lower portion of the limiting member 281. When the limiting member 281 is lowered together with the shaft 276 due to the downward movement of the vertically supporting base 265, this slanting surface abuts against a slanting surface of a block 263 secured to the movable base 260. As a result, the rotation of the limiting member 281 is guided to the state shown in FIG. 5, thereby correcting the orientation of the tip of the feeler 280.

<Template Measuring Mechanism Section>

In FIG. 3, the template measuring mechanism section 300 is disposed on the front side (on the lower side in FIG. 3) of the holding section base 201. An arm 351, a holder 313, and a measuring pin 331 are exposed over the holding section base 201, while the other portions of the measuring mechanism are accommodated below the lower surface of the holding section base 201. The movable range of the front slider 202 is so set that the front slider 202 does not interfere with the arm 351, the holder 313, and the like. Since it is unnecessary to hold the frame F during the measurement of the template (or the dummy lens), the front slider 202 is set in the closed state. Accordingly, in this state, a space corresponding to the movable range of the front slider 202 is obtained on the front side of the holding section base 201. As a space for installing the template mounted on the holder 313 is provided in this space, the space necessary for moving the front slider 202 can be used commonly as the space necessary for the template measurement. Thus, the space saving of the device can be attained. In particular, in the case of the device in which the target lens shape measuring device 2 is arranged in the eyeglass-lens processing apparatus as a unitary body according to the present embodiment, various mechanism sections such as the lens processing section need to be accommodated in the main body 1. Hence, it is advantageous to make the apparatus compact by making effective use of the limited space.

Figure 7A:
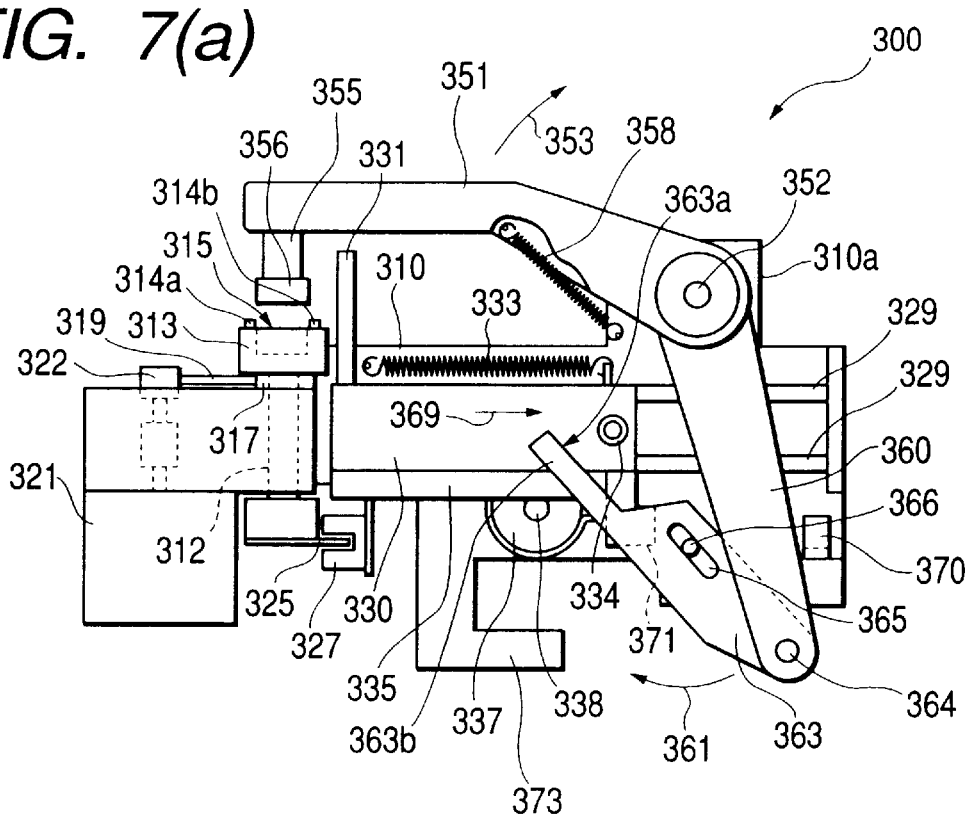
FIG. 7 is a diagram explaining a template measuring mechanism section.
Figure 7B:
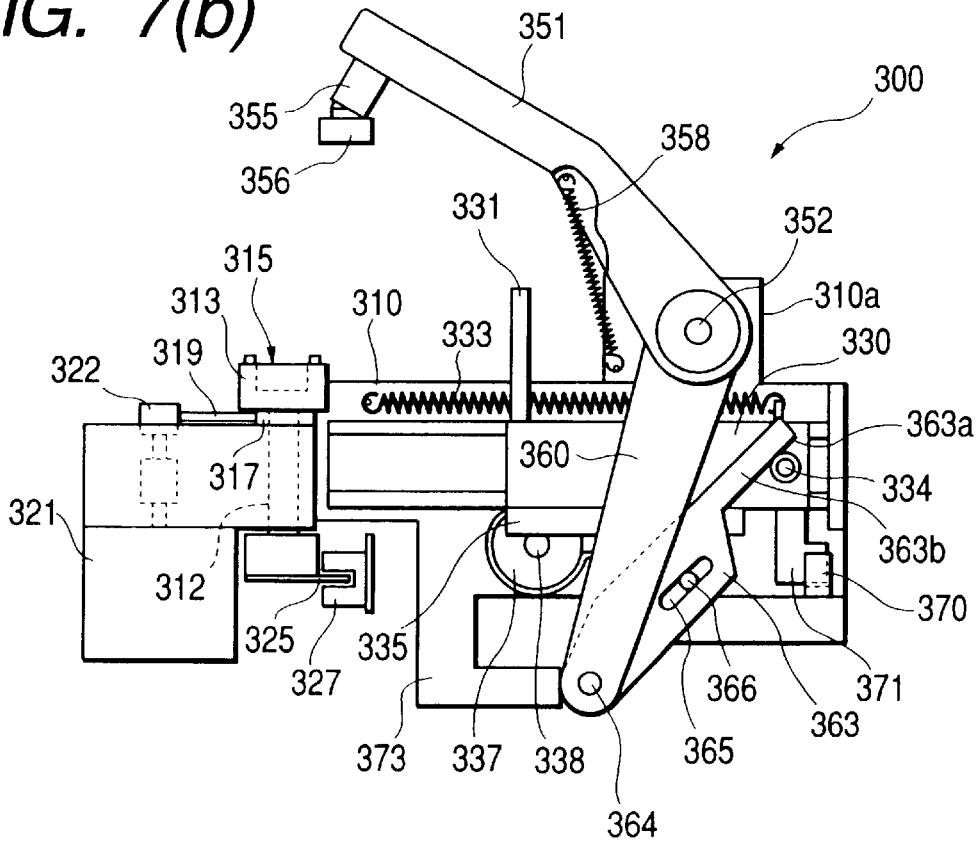
Figure 8A:
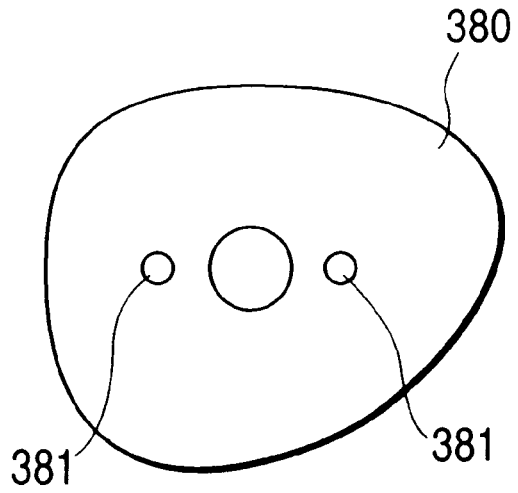
FIG. 8 is a diagram illustrating a template and a dummy lens which are mounted in the template measuring mechanism section.
Figure 8B:
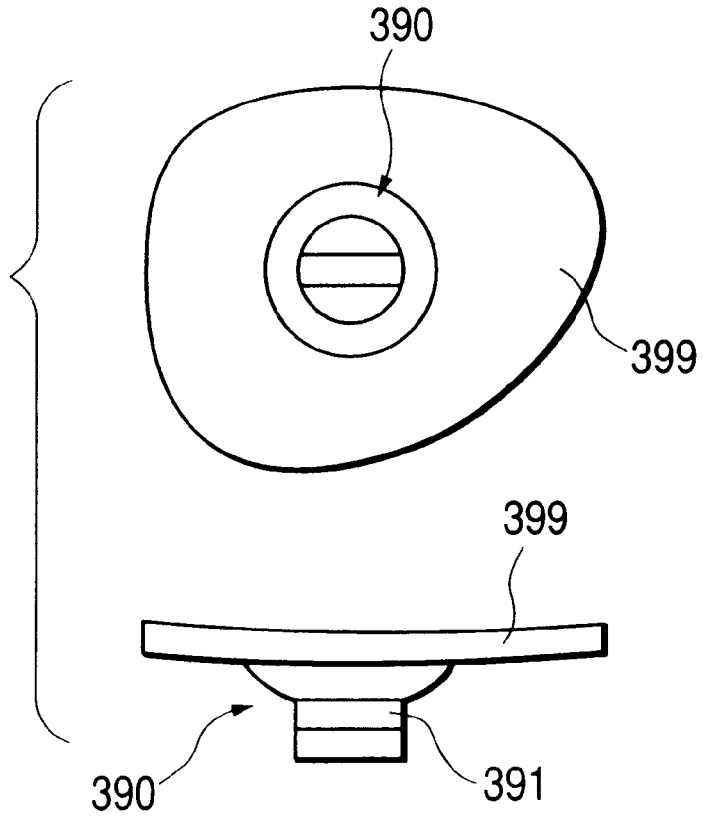

Referring to FIG. 7, a description will be given of the construction of the template measuring mechanism section 300. FIG. 7 shows a side elevational view, taken from the front slider 202 side, of the template measuring mechanism section 300. In FIGS. 7(*a*) and 7(*b*), reference numeral 310 denotes a template measuring base which is fixed below the holding section base 201. A vertically extending shaft 312 is rotatably held by the template measuring base 310, and the holder 313 for mounting a template 380 is fixed to an upper end of the shaft 312. A pair of pins 314*a* and 314*b* for engagement with two holes 381 formed in the template 380 shown in FIG. 8(*a*) are implanted or projectingly provided on an upper surface of the holder 313. Further, a hole 315, into which a proximal portion 391 of a cup 390 with a dummy lens 399 fixed thereto as shown in FIG. 8(*b*) is inserted, is formed in the center of an upper portion of the holder 313, and a projecting portion for fitting in a key groove of the cup proximal portion 391 is formed in its interior.

A gear 317 fixed to the shaft 312 is provided below the holder 313. Further, a pulse motor 321 for rotating the holder 313 is fixed to the template measuring base 310, and a gear 322 linked to the rotating shaft of the motor 321 meshes with an idle gear 319. As this idle gear 319 meshes with the gear 317, the rotation of the pulse motor 321 is transmitted to the holder 313 to rotate the holder 313.

A sensor plate 325 for detecting the rotational position is fixed to a lower end portion of the shaft 312, and as a sensor 327 detects the rotation of the sensor plate 325, the rotational position of the holder 313 is detected.

In addition, a pin holder 330 is held on the template measuring base 310 in such a manner as to be movable in the left-and-right direction along rails 329 extending in the left-and-right direction in FIGS. 7(*a*) and 7(*b*). A measuring pin 331 is implanted or projectingly provided on the left-side upper end of the pin holder 330, and as the pin holder 330 is moved in the left-and-right direction, the measuring pin 331 is brought into contact with an end face of the template (or the dummy lens) The pin holder 330 is constantly urged toward the holder 313 by a spring 333, and the measuring pin 331 is set in a state of a butment against the end face of the template by this urging force.

A rack 335 is fixed to the lower side of the pin holder 330. This rack 335 meshes with a pinion 338 of an encoder 337 held on the template measuring base 310, and the amount of movement of the pin holder 330, i.e., the amount of movement of the measuring pin 331, is detected by the encoder 337.

The arm 351 exposed over the holding section base 201 is held in such a manner as to be swingable in the direction of arrow 353 about a shaft 352 attached to a block 310*a* of the template measuring base 310. A pressing member 356 for pressing the template (or the dummy lens) is attached to a distal end of the arm 351 with a hollow cylindrical member 355 disposed therebetween, so as to be oriented downward. The pressing portion 356 is attached to the hollow cylindrical member 355 through an unillustrated universal bush such that its lower surface freely moves about the axis of the hollow cylindrical member 355. Further, the arm 351 is constantly urged in the downward direction by a spring 358 stretched between the vicinity of its central portion and the base 310. As a result, a pressing force acting in the direction toward the holder 313 is imparted to the pressing member 356.

A coupling plate 360 is attached to the block 310*a* side of the arm 351, and the coupling plate 360 also swings about the shaft 352 in the direction of arrow 361 as the arm 351 swings in the direction of arrow 353. A lever 363 which is rotatable about a shaft 364 is attached to a lower portion of the coupling plate 360. An elongated hole 365 is formed in the vicinity of the center of the lever 363, and a fixing pin 366 secured to the template measuring base 310 is engaged with the elongated hole 365. Accordingly, as the coupling plate 360 swings in the direction of arrow 361, an end 363*b* of the lever 363 on the distal end side thereof (i.e. an end opposite from the shaft 364 with respect to the fixed pin 366) is swung in the direction of arrow 369 with the fixed pin 366 serving as a fulcrum.

An abutment surface 363*a* is formed on the end 363*b* of the lever 363 to be brought into contact with a roller 334 rotatably supported by the pin holder 330. When the lever 363 is swung in the direction of arrow 369 with the fixed pin 366 as the fulcrum, this abutment surface 363*a* is brought into contact with the roller 334 to move the pin holder 330 (the measuring pin 331) in the direction away from the holder 313.

Namely, if the arm 351 is swingably moved manually in the direction of arrow 353 in such a manner as to be lifted upward, the coupling plate 360 is swung in the direction of arrow 361 to move the end 363*b* of the lever 363 in the direction of arrow 369, thereby moving the pin holder 330 (the measuring pin 331) in a direction away from the holder 313 through the roller 364 pressed by the abutment surface 363*a*. In this manner, the swinging motion of the arm 351 is converted to the linear motion of the measuring pin 331. That is, when the arm 351 is swung to move the pressing member 356 in the direction away from the holder 313, the movement of the arm 351 is transmitted to the measuring pin 331 so that the measuring pin 331 is moved toward the retracting side, as shown in FIG. 7(*b*).

When the arm 351 in the lifted-up state is swung downward, the end 363*b* (the abutment surface 363*a*) of the lever 363 is moved in the opposite direction to the arrow 369 in association with the swinging of the arm 351. Since the pin holder 330 is urged in the direction toward the holder 313 by the spring 333, the pin holder 330 is returned in conjunction with the movement of the lever 363, so that the measuring pin 331 is moved to abut against the end face of the template (or the dummy lens) mounted on the holder 313. Namely, in association with the movement of the arm 351, the measuring pin 331 in the retracting side can be moved to the measuring position.

In FIGS. 7(*a*) and 7(*b*), a sensor 370 for detecting whether the pin holder 330 is moved to a rightmost position is attached to a right-hand end of a lower portion of the template measuring base 310, and a sensor plate 371 is attached to the pin holder 330 side. As the sensor 370 detects the sensor plate 371, a reference for detection of the amount of movement is determined for the encoder 347. Reference numeral 373 denotes a stopper for restricting the swinging limit of the coupling plate 360 (the arm 351), and the stopper 373 is attached to the template measuring base 310.

Figure 9:
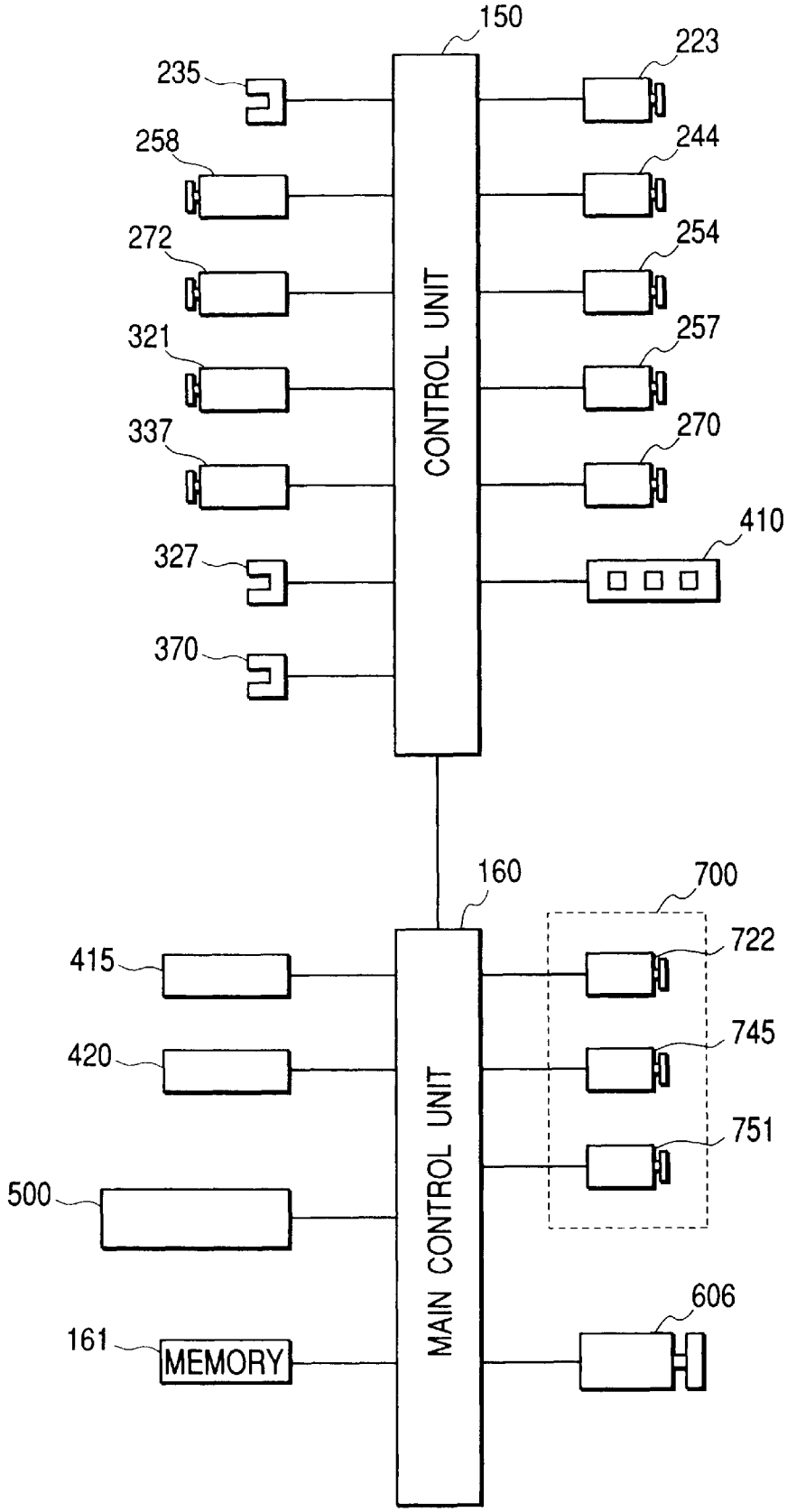
FIG. 9 is a block diagram of a control system of the apparatus.

Next, with reference to a block diagram of the control system shown in FIG. 9, a description will be given centering on the operation of measuring the target lens shape by the apparatus having the above-described construction.

First, a description will be given of the measurement of the shape of the frame F. The front slider 202 is pulled toward the front side (the operator side) to widen the distance between the front slider 202 and the rear slider 203, and the frame F is positioned between the mating clamp pins at the four locations. Since centripetal forces for moving toward the reference line L1 are constantly acting in the front slider 202 and the rear slider 203 owing to the spring 213, the distance between the two sliders 202 and 203 is thereby narrowed, and the frame F is held with the reference line L1 as the center.

Upon completion of the setting of the frame F, a both-eye tracing switch 412 of the switch panel section 410 is pressed. Then, a control unit 150 on the target lens shape measuring device 2 drives the motor 223, and as the shaft 220 is rotated, the clamp pins at four locations are closed to fix the frame. F. Upon completion of the fixation of the frame F, the measuring section 240 is operated to measure the shape of the lens frame of the frame F. In the case of both-eye tracing, the control unit 150 moves the transversely movable base 241 in advance by driving the motor 244 so that the feeler 280 is located at a predetermined position on the right frame portion of the frame F. In addition, by driving the motor 254, the rotating base 250 is rotated in advance to effect initialization so that a tip of the feeler 280 faces the clamp pins 230R*a*, 230R*b* side. Subsequently, the vertically supporting base 265 is raised by driving the motor 270 to allow the feeler 280 to be located at the height of the measurement reference plane. The amount of movement at the time the feeler 280 is raised from a lowest-point position can be obtained from the detection by the encoder 272, and the control unit 150 causes the feeler 280 to be located at the height of the measurement reference plane on the basis of the detection information of the encoder 272.

Subsequently, the control unit 150 drives the motor 257 to move the movable base 260, and thereby allows the tip of the feeler 280 to be inserted in the frame groove of the frame F. During this movement, since a DC motor is used as the motor 257, the driving current (driving torque) to the motor 257 can be controlled to provide a desired pressing force. Subsequently, the pulse motor 254 is rotated in accordance with each predetermined unit number of rotational pulses to rotate the feeler unit 255 together with the rotating base 250. As a result of this rotation, the movable base 260 together with the feeler 280 moves along the direction of the rail of the guide rail receiver 256*a* in accordance with the radius vector of the frame groove, and the amount of its movement is detected by the encoder 258. Further, the vertically supporting base 265 together with the feeler 280 moves vertically along the warp (curve) of the frame groove, and the amount of its movement is detected by the encoder 272. From the angle of rotation θ of the pulse motor 254, the amount r detected by the encoder 258, and the amount z detected by the encoder 272, the lens frame shape is measured as (rn, θn, zn) (n=1, 2, . . . , N).

Next, a description will be given of the case in which the target lens shape of the template 380 is measured. Since the frame measuring section 240 is not used, the front slider 202 and the rear slider 203 of the frame holding section 200 are in the state of being closed by the spring 213. This state is detected by the sensor 235, and thus the template measurement mode is recognized.

To set the template 380 on the holder 313, the operator manually grips the arm 351 and pulls it upward (causes the arm 351 to swing about the shaft 352 in the direction of arrow 353). In association with this movement of the arm 351, the measuring pin 331 together with the pin holder 330 moves in the direction away from the holder 313. When the arm 351 is swung to its limit of movement (to the position where the coupling plate 360 is brought into contact with the stopper 373), the pin holder 330 reaches the right end as shown in FIG. 7(*b*), which is detected by the sensor 370.

The operator allows the two holes 381 in the template 380 to engage the pins 314*a* and 314*b* of the holder 313, there by mounting the template 380. If the arm 351 is returned (lowered), the template 380 mounted on the holder 313 is pressed and held by the pressing member 356. Further, since the end 363*b* (abutment surface 363*a*) of the lever 363 moves toward the holder 313 in association with the movement of the arm 351, the pin holder 330 also moves toward the holder 313 by the urging force of the spring 333, and the measuring pin 331 is moved to the measuring position where it abuts against the end face of the template 380. Since the measuring pin 331 is disposed at the measuring position in association with the movement of the arm 351 for fixing the template 380, the operation is simple without requiring a special operation.

After setting the template 380, in a case where the template to be measured is for the right eye, a right trace switch 413 of the switch panel section 410 is pressed, while in a case where the template to be measured is for the left eye, a left trace switch 411 is pressed. The control unit 150 causes the pulse motor 321 to be rotatively driven for each predetermined unit number of rotational pulses by the input of a switch signal, so as to rotate the holder 313. Since the template 380 rotates due to this rotation, the measuring pin 331 moves in accordance with the radius vector of the template 380. Its amount of movement is detected by the encoder 337. On the basis of the rotational angle θ of the pulse motor 321 and the detection amount r by the encoder 337, the target lens shape of the template 380 is measured as (rn, θn) (n=1, 2, . . . , N).

Upon completion of the measurement, the arm 351 is pulled upward, and the template 380 is removed. In this case as well, since the measuring pin 331 moves in the direction away from the holder 313 in association with the movement of the arm 351, the template 380 can be removed easily.

Although a description has been given of the case of the measurement of the template 380, the measurement of a dummy lens 399 can be performed in a similar manner.

After the measurement of the template 380, if the operator presses a data switch 421 of the switch panel section 420, the measured target lens shape data are transferred to a data memory 161, and the target lens shape is graphically displayed on the display 415. By operating data-inputting switches arranged on the switch panel section 420, the operator enters necessary data including layout data such as the PD value of the wearer and positional data on the optical center height, as well as processing conditions such as the material of the frame, lens material, and the like. Subsequently, the lens LE to be processed is clamped by a pair of lens chuck shafts 702L and 702R, and processing is performed.

A main control unit 160 first executes the lens shape measurement by using the lens-shape measuring section 500 in accordance with a processing sequence program. Subsequently, on the basis of the target lens shape data the main control unit 160 controls the driving of a carriage raising/lowering motor 751 (for changing the axis-to-axis distance between the abrasive-wheel rotating shaft and the lens rotating shaft), a carriage transversely-moving motor 745 (for moving the lens LE in the direction toward the lens rotating shaft (abrasive-wheel rotating shaft)), a chuck-shaft rotating motor 722 (for rotating the lens LE), and the like of the carriage section 700, so as to perform processing by causing the lens LE to be brought into pressure contact with the group of abrasive wheels 602 rotated by the motor 606.

As described above, in accordance with the invention, at the time of measurement of the template or the dummy lens, it is possible to effect measurement in a simple operation without requiring the preparation of a fixing jig or its installation.

In addition, since the mechanism for the template measurement and the mechanism for the eyeglass frame measurement are provided independently while commonly using the space, space saving can be attained in the installation of the mechanisms while improving the operational efficiency.

What is claimed is:

1. A target lens shape measuring device for measuring a target lens shape for processing an eyeglass lens, said device comprising:

a mount on which at least one of a template and a base of a fixing cup to which a dummy lens is attached is to be mounted;

a fixing portion for pressing and fixing the template or the dummy lens mounted on the mount during measurement;

moving means for moving the fixing portion between a pressing position, at which the fixing portion presses the template or the dummy lens, and a non-pressing position;

a measuring pin to be brought into contact with a periphery of the template or the dummy lens mounted on the mount;

movement detecting means for detecting an amount of movement of the measuring pin to obtain a target lens shape; and linking means for moving the measuring pin from a retracted position to a measuring position in linking with movement of the fixing portion from the non-pressing position to the pressing position by the moving means.

2. The target lens shape measuring device of claim 1, wherein the mount includes a side wall portion on which positioning pins for insertion into small holes of the template are projectingly provided, and an insertion hole surrounded by the side wall portion for receiving the base of the fixing cup.

3. The target lens shape measuring device of claim 1, further comprising:

rotating means for rotating the mount, wherein the fixing portion includes a rotatable contact portion to be brought into contact with the template or the dummy lens mounted on the mount.

4. The target lens shape measuring device of claim 1, further comprising:

rotating means for rotating the mount;

rotation detecting means for detecting a rotational angle of the rotating means or a rotational angle of the mount by the rotating means;

arithmetic means for obtaining the target lens shape based on the amount of movement of the measuring pin detected by the movement detecting means and the rotational angle detected by the rotation detecting means.

5. The target lens shape measuring device of claim 1, further comprising:

arithmetic means for obtaining the target lens shape based on the amount of movement of the measuring pin detected by the movement detecting means.

6. The target lens shape measuring device of claim 1, further comprising:

an eyeglass frame holding unit including:

a pair of sliders to be respectively brought into contact with upper and lower end surfaces of an eyeglass frame;

clamping pins for clamping the eyeglass frame; and urging means for moving the sliders to a position at which the sliders do not interfere with the template or the dummy lens mounted on the mount, wherein measurement of the template or the dummy lens is carried out using a space obtained as a consequence of moving the sliders by the urging means.

7. The target lens shape measuring device of claim 6, further comprising:

position detecting means for detecting whether or not the sliders are located at the position at which the sliders do not interfere with the template or the dummy lens on the mount;

mode determining means for determining a template measurement mode, in which the template or the dummy lens is measured, based on result of detection of the position detecting means.

8. An eyeglass-lens processing apparatus, having the target lens shape measuring device of claim 1, for processing the eyeglass lens based on the obtained target lens shape, comprising:

lens processing means having a rotatable abrasive wheel and a lens rotating shaft for holding and rotating the lens; and control means for controlling the lens processing means based on an obtained target lens shape.

9. A target lens shape measuring device that measures a target lens shape for processing an eyeglass lens, said device comprising:

a mount on which one of a template and a base of a fixing cup to which a dummy lens is attached is mounted;

a fixing portion that presses and fixes the template or the dummy lens mounted on the mount during measurement, the fixing portion moves between a pressing position, at which the fixing portion presses the template or the dummy lens, and a non-pressing position;

a measuring pin that is brought from a retracted position to a measuring position in which the measuring pin is in contact with a periphery of the template or the dummy lens mounted on the mount;

a detector that detects an amount of movement of the measuring pin to obtain a target lens shape; and linkage that moves the measuring pin from the retracted position to the measuring position when the fixing portion is moved from the non-pressing position to the pressing position.

10. The target lens shape measuring device according to claim 9, wherein the linkage includes an arm that rotates about a pivot, and wherein the linkage translates rotary motion of the arm into linear motion of the measuring pin.

11. The target lens shape measuring device according to claim 10, wherein the measuring pin is biased in a direction of the measuring position.

* * * * *